US012310414B2

(12) United States Patent
Cristian

(10) Patent No.: US 12,310,414 B2
(45) Date of Patent: May 27, 2025

(54) AEROSOL-GENERATING DEVICE WITH ADAPTABLE HAPTIC FEEDBACK

(71) Applicant: Philip Morris Products S.A., Neuchatel (CH)

(72) Inventor: Gregory André Cristian, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 856 days.

(21) Appl. No.: 17/256,890

(22) PCT Filed: Jul. 5, 2019

(86) PCT No.: PCT/EP2019/068092

§ 371 (c)(1),
(2) Date: Dec. 29, 2020

(87) PCT Pub. No.: WO2020/008028

PCT Pub. Date: Jan. 9, 2020

(65) Prior Publication Data

US 2021/0282465 A1 Sep. 16, 2021

(30) Foreign Application Priority Data

Jul. 6, 2018 (EP) ..... 18182217

(51) Int. Cl.
*A24F 40/53* (2020.01)
*A24F 40/51* (2020.01)
*A24F 40/60* (2020.01)

(52) U.S. Cl.
CPC ..... *A24F 40/53* (2020.01); *A24F 40/51* (2020.01); *A24F 40/60* (2020.01)

(58) Field of Classification Search
None
See application file for complete search history.

(56) References Cited

U.S. PATENT DOCUMENTS 10,362,804 B2 * 7/2019 Bessant ..... G08B 6/00
10,973,258 B2 * 4/2021 Alarcon ..... A61M 15/0083
(Continued)

FOREIGN PATENT DOCUMENTS

CA 2 986 846 A1 12/2016
CN 105473014 A 4/2016
(Continued)

OTHER PUBLICATIONS

Opposition filed by Nicoventures Trading Limited on Jan. 5, 2023 in European Patent Application No. 19735336.0, citing documents 1-6 and 15-16, and 25 therein, 45 pages.
(Continued)

*Primary Examiner* — Ross N Gushi
(74) *Attorney, Agent, or Firm* — Oblon, McClelland, Maier & Neustadt, L.L.P.

(57) ABSTRACT

An aerosol-generating device for generating an inhalable aerosol is provided, the device including: a haptic element to provide a haptic feedback to a user; an airflow sensor to detect airflow through an airflow channel of the device; a detection element to detect at least one of: a type of aerosol-generating article inserted into a heating chamber of the device, a length of a draw of the user, a number of draws over a period of time, and a time of day of the draw of the user; and a controller, being connected with the detection element and the haptic element, and being configured to control an operation of the haptic element based on the detection element. A method for manufacturing an aerosol-generating device for generating an inhalable aerosol is also provided.

11 Claims, 5 Drawing Sheets

(56) References Cited

U.S. PATENT DOCUMENTS

| | | | | |
|---|---|---|---|---|
| 2006/0047368 | A1 | 3/2006 | Maharajh et al. | |
| 2007/0074722 | A1 | 4/2007 | Giroux et al. | |
| 2008/0245363 | A1 | 10/2008 | Korevaar et al. | |
| 2011/0094523 | A1 | 4/2011 | Thorens et al. | |
| 2013/0306065 | A1 | 11/2013 | Thorens et al. | |
| 2013/0340775 | A1* | 12/2013 | Juster | H04L 12/1827 131/273 |
| 2015/0020825 | A1 | 1/2015 | Galloway et al. | |
| 2015/0257445 | A1 | 9/2015 | Henry, Jr. et al. | |
| 2015/0257448 | A1 | 9/2015 | Lord | |
| 2015/0258289 | A1 | 9/2015 | Henry, Jr. et al. | |
| 2016/0007651 | A1 | 1/2016 | Ampolini et al. | |
| 2016/0219933 | A1 | 8/2016 | Henry, Jr. et al. | |
| 2017/0196269 | A1 | 7/2017 | Bernauer et al. | |
| 2017/0304567 | A1* | 10/2017 | Adelson | A61M 11/042 |
| 2017/0332701 | A1* | 11/2017 | Fornarelli | H05B 3/141 |
| 2019/0090541 | A1 | 3/2019 | Bernauer | |
| 2019/0261692 | A1 | 8/2019 | Henry, Jr. et al. | |

FOREIGN PATENT DOCUMENTS

| | | | |
|---|---|---|---|
| CN | 107438372 | A | 12/2017 |
| CN | 108025149 | A | 5/2018 |
| DE | 10 2015 121 596 | A1 | 6/2017 |
| EP | 3 610 747 | A2 | 2/2020 |
| JP | 2015-532158 | A | 11/2015 |
| JP | 2017-512480 4 | | 5/2017 |
| KR | 10-2018-0070443 | A | 6/2018 |
| KR | 10-2020-0129158 | A | 11/2020 |
| KZ | 31524 | B | 9/2016 |
| RU | 2 644 314 | C2 | 2/2018 |
| RU | 2 646 554 | C2 | 3/2018 |
| RU | 2 646 557 | C2 | 3/2018 |
| RU | 2 653 467 | C2 | 5/2018 |
| WO | WO 2010/073122 | A1 | 7/2010 |
| WO | WO 2014/060268 | A1 | 4/2014 |
| WO | WO 2015/138589 | A1 | 9/2015 |
| WO | WO 2016/009202 | A1 | 1/2016 |
| WO | WO 2016/090303 | A1 | 6/2016 |
| WO | WO 2017/056103 | A1 | 4/2017 |
| WO | WO 2017/118553 | A1 | 7/2017 |
| WO | WO 2017/149093 | A1 | 9/2017 |
| WO | WO 2017/201221 | A1 | 11/2017 |
| WO | WO 2017/205692 | A1 | 11/2017 |
| WO | WO 2018/025217 | A1 | 2/2018 |
| WO | WO 2018/109611 | A1 | 6/2018 |

OTHER PUBLICATIONS

Opposition filed by JT International S.A. on Jan. 9, 2023 in European Patent Application No. 19735336.0, citing documents 1, 7-8, and 17-21 therein, 40 pages.

G.M. Hidy, et al., "The Dynamics of Aerocolloidal Systems," International Reviews in Aerosol Physics and Chemistry, vol. 1, Pergamon Press Inc., 1970, 420 pages.

Decision to Grant issued on Jun. 16, 2021 in Russian Patent Application No. 2020142236 (submitting English translation only), citing documents AO-AV therein, 8 pages.

Korean Office Action issued Dec. 12, 2022 in Korean Patent Application No. 10-2020-7036569 (with English translation), citing references 15 and 24 therein, 8 pages.

Son, "Haptic Actuators in Mobile Devices", Nosie and Vibration, vol. 22, No. 6, Dec. 2012, pp. 25-30.

Opposition filed by Imperial Tobacco Limited on Jan. 5, 2023 in European Patent Application No. 19735336.0, citing documents 1 and 15-19 therein, 24 pages.

Japanese Office Action issued Feb. 9, 2022 in Japanese Patent Application No. 2020-570945 (submitting English translation only), citing documents AO and AP therein, 9 pages.

Combined Chinese Office Action and Search Report issued Oct. 13, 2023 in Chinese Patent Application No. 201980044522.2 (with English Translation), citing reference 1 therein, 14 pages.

EPO Interlocutory Decision issued in counterpart European patent EP3817608, dated Nov. 20, 2024 (31 pages).

International Search Report and Written Opinion issued Oct. 15, 2019 in PCT/EP2019/068092 filed Jul. 5, 2019.

* cited by examiner

AEROSOL-GENERATING DEVICE WITH ADAPTABLE HAPTIC FEEDBACK

The present invention relates to an aerosol-generating device for generating an inhalable aerosol.

It is known to provide an aerosol-generating device, into which aerosol-generating articles containing aerosol-generating substrate can be inserted. The aerosol-generating articles are inserted into a heating chamber of these devices. A heating element such as a heating pin or heating blade is arranged in the heating chamber and is configured to penetrate into the aerosol-generating article and the aerosol-generating substrate, when the aerosol-generating article is inserted into the heating chamber.

In a different kind of smoking article, it is known to create a feedback to the user when the user draws on the smoking article. Such a smoking device is disclosed in EP 3 295 812 A1. In this device, a flow-driven vibration component is provided, which is configured to provide a tactile simulation to the user as a reaction of a flow passing along a flow path way of the device. The generated vibration may increase when the flow drawn by the user increases and decrease when the flow drawn by the user decreases. This device is mechanically complex and the vibrational feedback cannot be changed easily.

It would be desirable to have an aerosol-generating device with a haptic feedback, wherein the haptic feedback is flexible and easy to implement.

According to an aspect of the invention there is provided an aerosol-generating device for generating an inhalable aerosol. The device comprises a haptic element configured to create a haptic feedback to a user. The device comprises an airflow sensor configured to detect airflow through an airflow channel of the device and a detection element configured to detect at least one of: a type of aerosol-generating article inserted into a heating chamber of the device, a type of desired haptic feedback, a length of a draw of a user, a number of draws over a period of time, a time of the day of a draw of a user and a stage of a draw of a user. The device further comprises a controller, which is connected with the detection element and with the haptic element. The controller is configured for controlling the operation of the haptic element based on said detection element. The controller in other words controls the operation of the haptic element based on the detection output of the detection element.

The device according to the present invention enhances intuitiveness and feeling of control due to the fact that the user experience is optimized by means of the haptic feedback. As a consequence, a richer and more dynamic sensorial experience is achieved. Due to the different haptic feedbacks that are possible with the present invention, an increased user-choice and wider range of experiences is possible. An enhanced device feedback is generated due to different haptic feedbacks being possible based on the detected airflow, the detected type of article or the detected type of desired haptic feedback. The optimized haptic feedback may also lead to conversion and retention aid during usage of different types of insertable articles.

The haptic element may be configured as a haptic motor. The haptic motor may be configured for creating forces, vibrations or motions which may be experienced by a user holding the device. Preferably, the haptic motor may be configured for creating a vibration profile. The haptic motor may be configured as an eccentric rotating mass actuator, consisting of an unbalanced weight attached to a motor shaft. As the shaft rotates, the spinning of this irregular mass may cause the actuator, and in turn, the attached device, to shake. Alternatively or additionally, the haptic motor may be configured as a piezoelectric actuator.

The haptic motor may be connected with a power supply for supplying electrical energy to the haptic motor. The haptic motor preferably comprises a movable element and a stationary body, wherein the movement of the movable element may lead to a vibration of the aerosol-generating device. The haptic motor may be configured for different operation profiles, in which the length, strength and frequency of vibration is controllable by the controller. The haptic motor may be configured as a linear resonant actuator. The linear resonant actuator may be configured to move a mass in a reciprocal manner by means of a magnetic voice coil. A quick response may be obtained by using a linear resonant actuator.

The device may further comprise a user interface for connecting the device by wire or wireless with an external device. The type of desired haptic feedback may be specified by a user in the external device. The detection element may be connected with the user interface to detect the type of desired haptic feedback.

The external device may be a smartphone or a smartwatch. The user interface may provide for connection with the external device via at least one of Bluetooth, Wi-Fi, GSM/EDGE and UMTS/HSPA technologies. Alternatively or additionally, the external device may be connectable to the user interface via cable. The external device may comprise a display, which may preferably be touch-sensitive, for enabling a user to input a desired haptic feedback profile. The external device may be configured to display multiple different haptic feedback profiles to the user, and the user may be enabled to choose between these different haptic feedback profiles. The external device may be configured such that a user may select from the external device a curated range of haptic profiles to tailor their experience with the aerosol-generating device for them. In addition or alternatively, users may change the strength and profile of the haptic profiles. The profiles correspond to haptic draw responses.

The detection element may be configured to automatically detect the type of aerosol-generating article inserted into the heating chamber of the device. The controller of the aerosol-generating device may be configured to auto-adjust a haptic profile to pair with a detected inserted aerosol-generating article. For example, the aerosol-generating article may be configured as a mint pod, which will be paired to a subtle crisp and fresh haptic profile, ensuring that the haptics and flavor combined together create a unique user experience. The detection of the inserted article may be effected by providing a readable tag on the article such as a bar code. This tag may be recognized by the detection element and the controller may activate a corresponding haptic feedback such as a vibration profile during the user experience.

The detection of the type of article may include information such as the flavor or nicotine content of the article. Additionally, the detection element or the controller may be configured to detect at least one of a draw count and manually selected type of haptic feedback.

The detection element may comprise at least one of: a poka yoke, a mechanical fit corresponding to a mechanical fit of a specific type of insertable aerosol-generating article and a reader configured for reading a readable tag, preferably a bar code, on an insertable aerosol-generating article. For reading a readable tag, the detection element may comprise a reader, scanner, camera or different optical element. The detection element may be configured to enable detection of a type of article inserted into the heating chamber of the device. The controller may be configured connected with the detection element. The controller may be configured to operate the haptic element on basis of the detected type of inserted article.

A first-type article and a second-type article may be detectable by the detection element. A first-type article and a second-type article may differ in at least one of shape or size. The heating chamber of the device, into which the articles may be inserted, may comprise a first structure for receiving a first-type article and may comprise a second structure for receiving a second-type article or may comprise a structure selector for selecting between a first structure and a second structure. The first and second structures may differ in at least one of shape, size or position in the heating chamber. The structures of the heating chamber may correspond to the mechanical fit between the detection element and an insertable article.

The first-type or second-type article may be correlated with, for example received in, the first structure or in the second structure of the heating chamber. The detection element may recognize the type of article for controlling the haptic feedback.

All structures in the heating chamber corresponding to different types of articles may be present in the heating chamber at all times. By this, any type of article intended to be used in combination with the device may be inserted into the heating chamber. Shape or size of the articles may correspond to the respective structures in the heating chamber. Preferably, the article or a portion of the article forms a form fit with the corresponding structure of the heating chamber.

For example, the heating chamber may comprise, as a first structure, a cylindrical portion adapted for receiving a cylindrically shaped article. The heating chamber may comprise, as a second structure, a rectangular portion extending though and over the cylindrical portion. The rectangular portion may be adapted for receiving a rectangular shaped article.

Structures of the heating chamber may also be designed to be selectable at the time of use of the device by the structure selector. Thus, structures may be foreseen in the heating chamber or created or provided only upon use of the device and after the article to be consumed has been selected. A structure selector may be positioned accordingly such as to create the respective structure in the heating chamber to correspond to the selected type of article.

Such selection or provision of structures at the time of use may provide the advantage that the adaption of the device may, for example, directly be used as detection element. For example, the structure selector, for example realized in the form of a switch, may provide a first structure in a heating chamber wall when in a first position and may provide a second structure at a different position in the heating chamber wall when in a second position. The positions of the structure selector then directly correspond to a first-type article and a second-type article. Alternatively, the switch may not change structures but signal to the controller the use of a different type of aerosol-generating article. The different types of aerosol-generating article may differ in at least one of taste, nicotine content and used aerosol-generating substrate.

The first and the second structures may be structures in a heating chamber wall or may form portions of a heating chamber wall. For example, the first and second structures may be structures or form portions of a heating chamber bottom wall or of a heating chamber side wall.

For example, the heating chamber may comprise a recess arranged in a bottom wall of the heating chamber to receive any one of a first-type article or a second-type article in the recess. Preferably, the form and size of the recess corresponds to the form and size of a bottom portion of one type of article.

The entire bottom wall of the heating chamber may correspond to another type of article.

The heating chamber may have a shape and size corresponding to the shape and size of another type of article. For example, the heating chamber may have the form of a cylinder. The recess may then be a circular, for example centrally arranged recess having a smaller diameter than the bottom wall of the heating chamber. Thus, in such an embodiment the heating chamber of the device is adapted to receive two cylindrically shaped articles having different diameters, a smaller and a larger diameter.

The recess may comprise a puncturing member that extends from the recess into the direction of the heating chamber. Such a puncturing member may adapt the device to be usable in combination with articles requiring puncturing. For example, a cartridge or capsule may be punctured to gain access to an aerosol-forming substrate or an inhalable powder in the cartridge or capsule. The puncturing member may be open such as to allow airflow to pass through the puncturing member into or through the punctured article. Preferably, a puncturing member has a height which is the same or smaller than a depth of a recess such that the puncturing member does not extend over the recess. By this, another type of article, not requiring puncturing, inserted into the heating chamber but not inserted into the recess is kept unaffected by the puncturing member.

The structures of the heating chamber may, for example, be one or several notches in an opening portion of a heating chamber side wall. The arrangement and possibly also the shape or sizes of the notches may correspond to specific types of article. For example, the opening portion of the heating chamber side wall may comprise two oppositely arranged notches corresponding to an article having two opposite arranged lugs extending from the periphery of the article. The opening portion may have a third notch arranged in between the first and second notches. Accordingly, a second type of article may comprise two lugs extending from the periphery of the article, however which lugs are not oppositely arranged but at an angle smaller than 180 degree.

Notches in an opening portion of the heating chamber side wall are well suited for being selectable upon use of the device by a structure selector.

The first structure or the second structure or both the first and the second structures may be selectable by moving and thereby positioning the structure selector in the heating chamber. The structure selector may be a movable part of the heating chamber side wall. Different positions of the structure selector then correspond to notches such as for example slits or grooves, in the heating chamber side wall arranged at different positions in the heating chamber side wall.

The structure selector may also be a removable part of the chamber side wall. In the mounted position of the structure selector, the heating chamber is adapted to receive a first type of article. In the removed position of the structure selector, the heating chamber side wall comprises an opening such that the heating chamber is adapted to receive a second type of article. Preferably, a removable structure selector may be remounted such as to be in a mounted position again.

The structure selector may be a combined movable and removable part of the heating chamber. In such embodiments, different positions of the structure selector may create different recesses in the heating chamber side wall, while the removed structure selector corresponds to a further position of the structure selector.

The structure selector may also be a movable heating chamber wall portion, wherein different positions of the structure selector correspond to different diameters of the heating chamber.

The heating chamber of the aerosol-generating device may comprise a third structure for receiving a third-type article. The third structure may differ in at least one of shape, size or position in the heating chamber from the first structure and from the second structure. The heating chamber may be provided with a third structure in the heating chamber wall or the third structure may form portions of the heating chamber wall. For example, the bottom wall of the heating chamber may be provided with two recesses, for example to concentrically arranged recesses. Each of the recesses may, for example, be arranged in a staggered manner in the bottom of the heating chamber. One recess may then correspond to a first-type article, the second recess may then correspond to a second-type article and the entire bottom wall of the heating chamber may correspond to a third-type article.

One or several further notches may be provided in an opening portion of the heating chamber side wall.

A structure selector may be designed to be movable to a third position selecting the third structure. For example, movement of the structure selector may create a further notch at a different position or of a different shape, or both at a different position and of a different shape, in the opening portion of the heating chamber side wall.

Preferably, a third-type article differs from the first-type article and from the second-type article at least by its shape or size.

Alternatively or additionally to the heating chamber being configured for receiving different types of articles, the detection element may be configured so that the user manually specifies the desired haptic feedback. The detection element may comprise an actuator. The actuator may be configured to enable a user manually setting the type of desired haptic feedback by operating the actuator. The actuator may be a switch. The user may select different haptic profiles or settings directly from the device to personalize the experience across contexts or moments. The actuator may be utilized by the user to manually select the type of vibrational response preferred by the user.

The haptic feedback includes amplitude, duration, and frequency-based haptic response. In other words, the haptic feedback include an experiential haptic expression which provides feedback directly related to the strength, length, and timing of a draw. The experience includes a haptic 'wave-form' expression which evolves over the course of a pre-set period, giving users greater control and knowledge about their experience of using the aerosol-generating device. Complex Patterns such as an attack decay sustain release pattern includes a multi-layered haptic experience which transform over the course of a single impulse draw, or over the course of a whole using session to delight and stimulate the user.

The airflow sensor or the controller may be configured for detecting at least one of: the length of a draw of a user, the number of draws over a period of time, the time of the day of a draw of a user and the stage of a draw of a user. The airflow sensor, controller or detection element may be configured for detecting the strength of a draw of a user in conjunction with at least one of: the length of a draw of a user, the number of draws over a period of time, the time of the day of a draw of a user and the stage of a draw of a user.

The length of a draw of a user may be utilized by the controller for determining a specific haptic feedback suitable for this length of draw and for controlling the haptic element correspondingly. The number of draws over a period of time, the number of the day of a draw of a user and the stage of a draw for user may be utilized by the controller in a similar way. The controller may comprise multiple preset profiles of specific haptic feedbacks. These preset profiles may be utilized upon detection of a specific parameter of the airflow sensor. The preset profiles may alternatively or additionally be utilized upon detection of a specific type of inserted aerosol-generating article. A preset profile may also be manually chosen by a user.

The haptic element creating the haptic feedback may be configured to create an increasingly subtle haptic response with each subsequent draw of a user. This may let the user know that their consumption experience is drawing to a close, providing a further sense of clarity into their stage in the experience and, ultimately, satisfaction with it.

The airflow sensor may measure the airflow rate. The airflow rate is a parameter characterizing the amount of air that is drawn through the airflow channel of the aerosol-generating device per time by the user. The initiation of the draw may be detected by the airflow sensor when the airflow exceeds a predetermined threshold. The airflow sensor may be connected with the controller.

The sensor may be configured as a pressure sensor to measure the pressure of the air inside the aerosol-generating device which is drawn through an airflow channel of the device by the user during a draw. The airflow channel is provided between an air inlet and a mouth end of the device. The sensor may be configured to measure a pressure difference or pressure drop between the pressure of ambient air outside of the aerosol-generating device and of the air which is drawn through the device by the user. The air pressure may be detected at the air inlet, preferably a semi-open inlet, a mouth end of the device, the heating chamber or any other passage or chamber within the aerosol-generating device, through which the air flows. When the user draws on the aerosol-generating device, a negative pressure or vacuum may be created inside the device, wherein the negative pressure may be detected by the pressure sensor. The term "negative pressure" is to be understood as a relative pressure with respect to the pressure of ambient air. In other words, when the user draws on the device, the air which is drawn through the device has a pressure which is lower than the pressure of ambient air outside of the device. The initiation of the draw may be detected by the pressure sensor if the pressure difference exceeds a predetermined threshold.

The controller may be part of electric circuitry. The controller may be part of the electric circuitry. The electric circuitry may comprise a microprocessor, which may be a programmable microprocessor. The microprocessor may be part of the controller. The electric circuitry may comprise further electronic components. The electric circuitry may be configured to regulate a supply of power to the haptic element.

The power supply may be any suitable power supply, for example a DC voltage source such as a battery. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery.

As used herein, the term 'aerosol-forming substrate' relates to a substrate capable of releasing volatile compounds that can form an aerosol. Such volatile compounds may be released by heating the aerosol-forming substrate. An aerosol-forming substrate may conveniently be part of the aerosol-generating article or smoking article.

As used herein, the terms 'aerosol-generating article' refer to an article comprising an aerosol-forming substrate that is capable of releasing volatile compounds that can form an aerosol. For example, an aerosol-generating article may be a smoking article that generates an aerosol that is directly inhalable into a user's lungs through the user's mouth. An aerosol-generating article may be disposable. A smoking article comprising an aerosol-forming substrate comprising tobacco is referred to as a tobacco stick.

The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length.

The aerosol-generating article may have a total length between approximately 30 mm and approximately 100 mm. The aerosol-generating article may have an external diameter between approximately 5 mm and approximately 12 mm. The aerosol-generating article may comprise a filter plug. The filter plug may be located at a downstream end of the aerosol-generating article. The filter plug may be a cellulose acetate filter plug. The filter plug is approximately 7 mm in length in one embodiment, but may have a length of between approximately 5 mm to approximately 10 mm.

The aerosol-generating article may have a total length of approximately 45 mm. The aerosol-generating article may have an external diameter of approximately 7.2 mm. Further, the aerosol-forming substrate may have a length of approximately 10 mm. Alternatively, the aerosol-forming substrate may have a length of approximately 12 mm. Further, the diameter of the aerosol-forming substrate may be between approximately 5 mm and approximately 12 mm. The aerosol-generating article may comprise an outer paper wrapper. Further, the aerosol-generating article may comprise a separation between the aerosol-forming substrate and the filter plug. The separation may be approximately 18 mm, but may be in the range of approximately 5 mm to approximately 25 mm.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds which are released from the substrate upon heating. Alternatively, the aerosol-forming substrate may comprise a non-tobacco material. The aerosol-forming substrate may further comprise an aerosol former that facilitates the formation of a dense and stable aerosol. Examples of suitable aerosol formers are glycerin and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco, cast leaf tobacco and expanded tobacco. The solid aerosol-forming substrate may be in loose form, or may be provided in a suitable container or cartridge. Optionally, the solid aerosol-forming substrate may contain additional tobacco or non-tobacco volatile flavour compounds, to be released upon heating of the substrate. The solid aerosol-forming substrate may also contain capsules that, for example, include the additional tobacco or non-tobacco volatile flavour compounds and such capsules may melt during heating of the solid aerosol-forming substrate.

As used herein, homogenised tobacco refers to material formed by agglomerating particulate tobacco. Homogenised tobacco may be in the form of a sheet. Homogenised tobacco material may have an aerosol-former content of greater than 5% on a dry weight basis. Homogenised tobacco material may alternatively have an aerosol former content of between 5% and 30% by weight on a dry weight basis. Sheets of homogenised tobacco material may be formed by agglomerating particulate tobacco obtained by grinding or otherwise combining one or both of tobacco leaf lamina and tobacco leaf stems. Alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibers, aerosol-formers, humectants, plasticizers, flavourants, fillers, aqueous and non-aqueous solvents and combinations thereof.

Optionally, the solid aerosol-forming substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix.

The aerosol-forming substrate may comprise a gathered crimpled sheet of homogenised tobacco material. As used herein, the term 'crimped sheet' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled. In certain embodiments, the aerosol-forming substrate may comprise a gathered sheet of homogenised tobacco material that is substantially evenly textured over substantially its entire surface. For example, the aerosol-forming substrate may comprise a gathered crimped sheet of homogenised tobacco material comprising a plurality of substantially parallel ridges or corrugations that are substantially evenly spaced-apart across the width of the sheet.

The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

As used herein, an 'aerosol-generating device' relates to a device that interacts with an aerosol-forming substrate to generate an aerosol. The aerosol-forming substrate may be part of an aerosol-generating article, for example part of a smoking article. An aerosol-generating device may be a smoking device that interacts with an aerosol-forming substrate of an aerosol-generating article to generate an aerosol that is directly inhalable into a user's lungs thorough the user's mouth. An aerosol-generating device may be a holder.

The device is preferably a portable or handheld device that is comfortable to hold between the fingers of a single hand. The device may be substantially cylindrical in shape and has a length of between 70 and 120 mm. The maximum diameter of the device is preferably between 10 and 20 mm. In one embodiment the device has a polygonal cross section and has a protruding button formed on one face. In this embodiment, the diameter of the device is between 12.7 and 13.65 mm taken from a flat face to an opposing flat face; between 13.4 and 14.2 taken from an edge to an opposing edge (i.e., from the intersection of two faces on one side of the device to a corresponding intersection on the other side), and between 14.2 and 15 mm taken from a top of the button to an opposing bottom flat face. The device may be an electrically heated smoking device.

The aerosol-generating device may comprise a heating element for heating an article inserted into the heating chamber. The heating element may be a heating pin or heating blade. The device may also comprise electrical contacts arranged in the heating chamber for being connected and providing power to a heating element present in an article for heating the article. The controller may be configured for controlling power supply to the heating element or for controlling an aerosolization process.

The heating element may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum platinum, gold and silver. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese-, gold- and iron-containing alloys, and superalloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required.

The aerosol generating device may comprise an internal heating element or an external heating element, or both internal and external heating elements, where "internal" and "external" refer to the aerosol-forming substrate. An internal heating element may take any suitable form. For example, an internal heating element may take the form of a heating blade. Alternatively, the internal heater may take the form of a casing or substrate having different electro-conductive portions, or an electrically resistive metallic tube. Alternatively, the internal heating element may be one or more heating needles or rods that run through the center of the aerosol-forming substrate. Other alternatives include a heating wire or filament, for example a Ni—Cr (Nickel-Chromium), platinum, tungsten or alloy wire or a heating plate. Optionally, the internal heating element may be deposited in or on a rigid carrier material. In one such embodiment, the electrically resistive heating element may be formed using a metal having a defined relationship between temperature and resistivity. In such an exemplary device, the metal may be formed as a track on a suitable insulating material, such as ceramic material, and then sandwiched in another insulating material, such as a glass. Heaters formed in this manner may be used to both heat and monitor the temperature of the heating elements during operation.

An external heating element may take any suitable form. For example, an external heating element may take the form of one or more flexible heating foils on a dielectric substrate, such as polyimide. The flexible heating foils can be shaped to conform to the perimeter of the substrate receiving cavity. Alternatively, an external heating element may take the form of a metallic grid or grids, a flexible printed circuit board, a molded interconnect device (MID), ceramic heater, flexible carbon fibre heater or may be formed using a coating technique, such as plasma vapour deposition, on a suitable shaped substrate. An external heating element may also be formed using a metal having a defined relationship between temperature and resistivity. In such an exemplary device, the metal may be formed as a track between two layers of suitable insulating materials. An external heating element formed in this manner may be used to both heat and monitor the temperature of the external heating element during operation.

The heating element advantageously heats the aerosol-forming substrate by means of conduction. The heating element may be at least partially in contact with the substrate, or the carrier on which the substrate is deposited. Alternatively, the heat from either an internal or external heating element may be conducted to the substrate by means of a heat conductive element. The heating element may be configured as an induction heater. The induction heater may comprise an induction coil wound around the heating chamber. A susceptor material may be arranged in the heating chamber in the form of a pin or blade. Alternatively or additionally, susceptor material may be embedded in the aerosol-forming substrate contained in the aerosol-generating article.

During operation, the aerosol-forming substrate may be completely contained within the aerosol-generating device. In that case, a user may draw on a mouthpiece of the aerosol-generating device. Alternatively, during operation an aerosol-generating article containing the aerosol-forming substrate may be partially contained within the aerosol-generating device. In that case, the user may draw directly on the aerosol-generating article.

The invention also relates to a method for manufacturing an aerosol-generating device for generating an inhalable aerosol, wherein the method comprises the following steps:

i) pr providing a haptic element configured to create a haptic feedback to a user, ii) providing an airflow sensor configured to detect airflow through an airflow channel of the device, and iii) providing a detection element configured to detect at least one of: a type of aerosol-generating article inserted into a heating chamber of the device, a type of desired haptic feedback, a length of a draw of a user, a number of draws over a period of time, a time of the day of a draw of a user, a stage of a draw of a user, iv) providing a controller, the controller being connected with the detection element and with the haptic element, v) detecting, by the detection element, at least one of: a type of aerosol-generating article inserted into a heating chamber of the device, a type of desired haptic feedback, a length of a draw of a user, a number of draws over a period of time, a time of the day of a draw of a user, a stage of a draw of a user, and vi) controlling, by means of the controller, operation of the haptic element based on said detection element.

The invention will be further described, by way of example only, with reference to the accompanying drawings in which.

Figure 1:
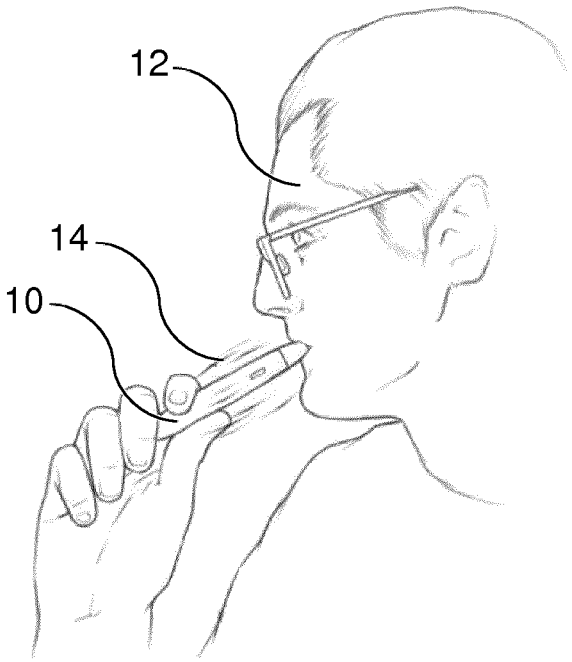
FIG. 1 shows the use of an aerosol-generating device according to the invention.

FIG. 1 shows the use of an aerosol-generating device 10. The device 10 is held by a user 12. The user 12 may draw on the aerosol-generating device 10. The aerosol-generating device 10 in configured for creating a haptic feedback 14 to the user 12 during use of the device 10. The haptic feedback 14 is preferably a vibration. The vibration may be varied during a single draw or during the course of a smoking experience. The haptic feedback 14 is a further sensorial input for the user 12 enhancing the smoking experience.

Figure 2:
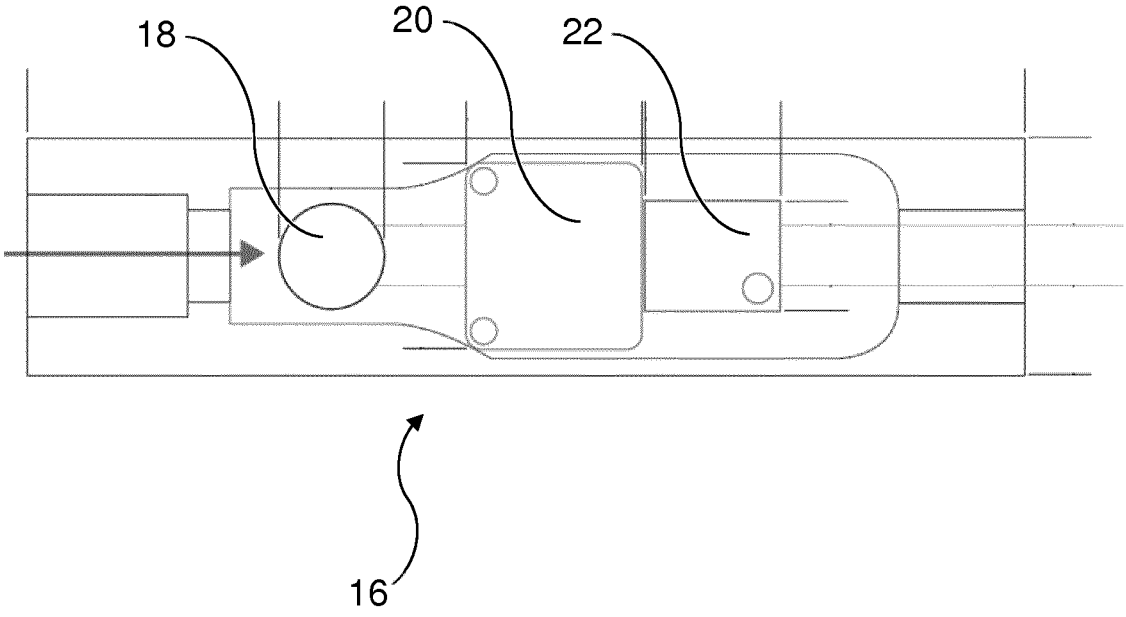
FIG. 2 shows internal components of the aerosol-generating device.

FIG. 2 shows internal components 16 of the aerosol-generating device 10. Particularly, FIG. 2 shows a haptic element 18 used for creating the haptic feedback 14 for a user 12. The haptic element 18 is preferably provided as a haptic motor such as a linear resonant actuator. The haptic element 18 is coupled to the housing of the aerosol-generating device 10 such that activation of the haptic element 18 leads to a vibration of the whole aerosol-generating device 10. The vibration can be sensed by a user 12 holding the device 10. In other words, the haptic element 18 is configured to create a haptic response to a user 12 when using the aerosol-generating device 10.

FIG. 2 shows further internal components 16 of the aerosol-generating device 10 such as a controller 20. The controller 20 is configured to controlling the operation of the haptic element 18. Different haptic feedback profiles 26 may be stored in the controller 20, for example in a look-up table. The controller 20 is connected with the haptic element 18 for controlling the haptic element 18. FIG. 2 shows a further internal component, an airflow sensor 22. The airflow sensor 22 may be provided for detecting airflow through the device 10. Airflow through the device 10 is indicated by the arrow in FIG. 2. The airflow sensor 22 may be configured to not only detect the presence or absence or airflow. The airflow sensor 22 may be connected with the controller 20. The airflow sensor 22 may be configured to detect at least one of: the length of a draw of a user 12, the number of draws over a period of time, the time of the day of a draw of a user 12 and the stage of a draw of a user 12. This data may be utilized by the controller 20 to control the haptic element 18. The controller 20 may choose a specific haptic feedback profile 26 in response to the detected airflow by the airflow sensor 22.

Figure 3:
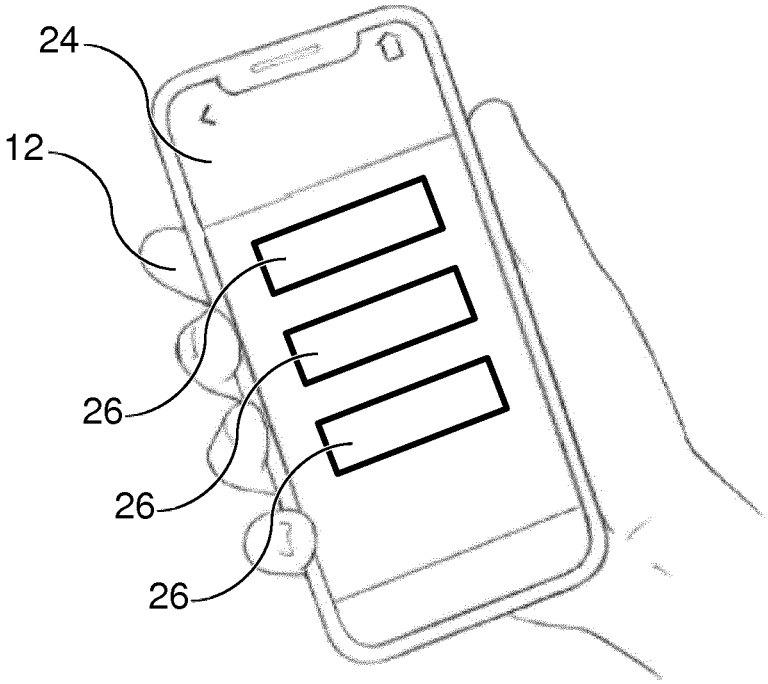
FIG. 3 shows an external device for choosing haptic feedback profiles for the aerosol-generating device.

FIG. 3 shows an external device 24 for manually choosing haptic feedback profiles 26. The external device 24 may be a smartphone. The external device 24 may also be a different device 10 such as a smartwatch. The external device 24 may be connectable with the aerosol-generating device 10 by wire or wireless, preferably by Bluetooth or Wi-Fi. The external device 24 comprises a display for displaying to the user 12 multiple haptic feedback profiles 26. The display is preferably a touch-sensitive display so that the user 12 may choose from the different haptic feedback profiles 26 by touching the respective areas on the display.

Figure 4:
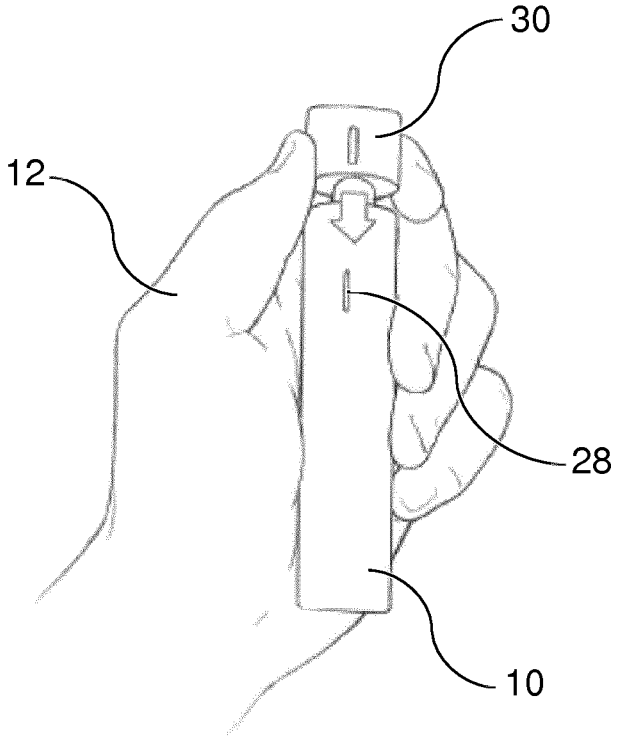
FIG. 4 shows the connection of an aerosol-generating article with the aerosol-generating device.

FIG. 4 shows an aspect in which the aerosol-generating device 10 comprises a detection element 28. The detection element 28 may be provided as a switch, as depicted in FIG. 4. However, the detection element 28 may also be provided as an automatic detection element 28 which automatically detects a type of an aerosol-generating article 30 inserted into a heating chamber of the aerosol-generating device 10. The switch may be utilized by a user 12 to manually set a haptic feedback profile 26. If the detection element 28 is provided as an automatic detection element 28, the detection element 28 may be configured as a reader configured to read a readable tag on the aerosol-generating article 30 such as a bar code. The detection element 28 may be provided to identify the type of aerosol-generating article 30 inserted into the heating chamber of the device 10. Preferably, the detection element 28 is provided in addition to the airflow sensor 22, wherein the detection element 28 is configured to detect one or more of the type of inserted aerosol-generating article 30, the desired haptic feedback profile 26 and the flow characteristics measured by the airflow sensor 22. The airflow sensor 22 is configured to detect an individual draw and the controller 20 is configured to control, based upon the detected article 30 or desired profile and the detected draw, the operation of the haptic element 18.

Figure 5:
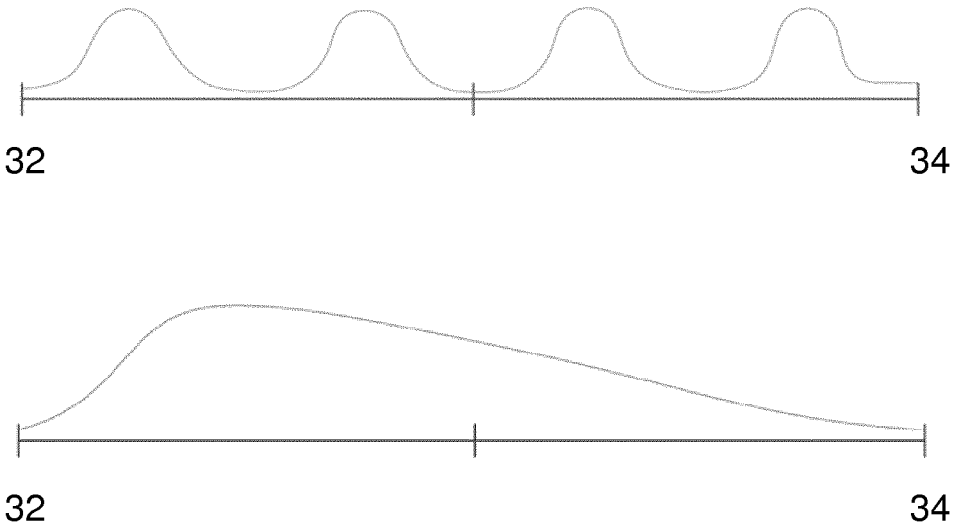
FIG. 5 shows different haptic feedback profiles.

FIG. 5 shows different haptic feedback profiles 26. The upper part or FIG. 5 shows a profile, in which the haptic element 18 is alternatingly operated from the start of a draw 32 of a user 12 towards the end of a draw 34 of a user 12. In a further haptic feedback profile 26, as shown in the below part of FIG. 5, the operation of the haptic element 18 is slowly decreased during a draw of a user 12 so as to give a further feedback to the user 12 regarding the length of the draw.

The invention claimed is:

1. An aerosol-generating device for generating an inhalable aerosol, the aerosol-generating device comprising:

a haptic element configured to provide a haptic feedback to a user;

an airflow sensor configured to detect airflow through an airflow channel of the aerosol-generating device;

a detection element configured to detect at least one of: a type of aerosol-generating article inserted into a heating chamber of the aerosol-generating device, a number of draws over a period of time, and a time of day of the draw of the user;

a controller, being connected with the detection element and the haptic element, and being configured to control an operation of the haptic element based on the detection element; and a user interface configured to connect the aerosol-generating device by wire or wirelessly with an external device, wherein a type of desired haptic feedback is specifiable by the user in the external device, and wherein the detection element is connected with the user interface to detect the type of the desired haptic feedback.

2. The aerosol-generating device according to claim 1, wherein the haptic element is configured as a haptic motor.

3. The aerosol-generating device according to claim 2, wherein the haptic motor is configured as a linear resonant actuator.

4. The aerosol-generating device according to claim 1, wherein the detection element is further configured to automatically detect the type of the aerosol-generating article inserted into the heating chamber of the aerosol-generating device.

5. The aerosol-generating device according to claim 1, wherein the detection element comprises at least one of: a poka yoke, a mechanical fit corresponding to a mechanical fit of a specific type of insertable aerosol-generating article, and a reader configured for reading a readable tag, on an insertable aerosol-generating article.

6. The aerosol-generating device according to claim 5, wherein the readable tag is a bar code on the insertable aerosol-generating article.

7. The aerosol-generating device according to claim 1, wherein the detection element comprises an actuator configured to enable the user to manually set a type of desired haptic feedback by operating the actuator.

8. The aerosol-generating device according to claim 7, wherein the actuator is a switch.

9. The aerosol-generating device according to claim 1, wherein the airflow sensor or the controller is further configured to detect at least one of: the number of draws over the period of time, and the time of day of the draw of the user.

10. The aerosol-generating device according to claim 1, wherein the airflow sensor is configured as a pressure sensor.

11. A method for operating an aerosol-generating device for generating an inhalable aerosol, the method comprising the following steps:

i) providing a haptic element configured to provide a haptic feedback to a user;

ii) providing an airflow sensor configured to detect airflow through an airflow channel of the aerosol-generating device;

iii) providing a user interface for connecting the device by wire or wireless with an external device;

iv) specifying a type of desired haptic feedback in the external device;

v) providing a detection element configured to detect at least one of: a type of aerosol-generating article inserted into a heating chamber of the aerosol-generating device, a number of draws over a period of time, and a time of day of a draw of the user;

vi) connecting the detection element with the user interface to detect said type of desired haptic feedback;

vii) providing a controller, the controller being connected with the detection element and with the haptic element;

viii) detecting, by the detection element, at least one of: the type of the aerosol-generating article inserted into the heating chamber of the aerosol-generating device, the number of draws over the period of time, and the time of day of the draw of the user, and ix) controlling, by the controller, an operation of the haptic element based on the detection element.

* * * * *